US009850688B2

(12) United States Patent
Stewart et al.

(10) Patent No.: US 9,850,688 B2
(45) Date of Patent: Dec. 26, 2017

(54) DYNAMIC MAGNETIC DETACHER

(71) Applicant: Sensormatic Electronics, LLC, Boca Raton, FL (US)

(72) Inventors: Justin Stewart, Deerfield Beach, FL (US); Ronald B. Easter, Parkland, FL (US)

(73) Assignee: Tyco Fire & Security GmbH, Neuhausen AM Rheinfall (CH)

( * ) Notice: Subject to any disclaimer, the term of this patent is extended or adjusted under 35 U.S.C. 154(b) by 287 days.

(21) Appl. No.: 13/754,165

(22) Filed: Jan. 30, 2013

(65) Prior Publication Data

US 2014/0208559 A1 Jul. 31, 2014

(51) Int. Cl.
*G08B 13/14* (2006.01)
*E05B 73/00* (2006.01)

(52) U.S. Cl.
CPC ..... *E05B 73/0052* (2013.01); *G08B 13/14* (2013.01); *Y10T 29/53991* (2015.01)

(58) Field of Classification Search
CPC ..... E05B 73/0052; Y10T 29/53991
USPC ..... 269/8; 29/281.1, 281.5, 283; 335/222, 335/229–234, 289–296; 310/90.5; 70/57.1, 58, 276, 413
See application file for complete search history.

(56) References Cited

U.S. PATENT DOCUMENTS 3,947,930 A 4/1976 Martens et al.
4,339,853 A 7/1982 Lipschitz
4,462,013 A * 7/1984 Ueda et al. ..... 335/229
4,987,754 A 1/1991 Minasy et al.
5,532,532 A * 7/1996 DeVault et al. ..... 310/52
5,942,978 A 8/1999 Shafer
6,005,459 A * 12/1999 Hoffman ..... 335/177
6,084,498 A 7/2000 Stelter et al.
6,414,577 B1 * 7/2002 Hoffman ..... 335/229
7,190,272 B2 3/2007 Yang et al.
7,242,304 B2 7/2007 Clancy et al.
7,391,327 B2 6/2008 Ho
7,750,806 B1 7/2010 Skjellerup et al.
7,821,403 B2 10/2010 Hogan
8,051,686 B2 11/2011 Garner
2005/0190060 A1 * 9/2005 Clancy et al. ..... 340/572.9
2006/0097872 A1 * 5/2006 Ho ..... 340/572.1
2009/0064734 A1 3/2009 Zinner
2009/0224918 A1 * 9/2009 Copeland ..... 340/572.1
2009/0229327 A1 9/2009 Valade, Jr. et al.
(Continued)

FOREIGN PATENT DOCUMENTS

EP 1957735 A1 8/2008

*Primary Examiner* — Joseph J Hail
*Assistant Examiner* — Jon Taylor
(74) *Attorney, Agent, or Firm* — Fox Rothschild LLP; Robert J. Sacco; Carol E. Thorstad-Forsyth

(57) ABSTRACT

A system is provided. The system includes a detacher. The detacher includes a field source. The field source is arranged to provide a first magnetic field when power is applied to the field source. The detacher further includes a magnet arranged to provide a second magnetic field. The magnet is movable from a non-detach position to a detach position when exposed to the first magnetic field. The second magnetic field is arranged to unlock a security tag when the magnet is at the detach location. The system further includes an activation device. The activation device includes a processor configured to trigger power to be supplied to the field source.

22 Claims, 7 Drawing Sheets

(56) References Cited

U.S. PATENT DOCUMENTS

| | | | | |
|---|---|---|---|---|
| 2009/0241719 | A1* | 10/2009 | Fu et al. | 74/490.08 |
| 2010/0008009 | A1* | 1/2010 | Cartier-Millon et al. | 361/156 |
| 2010/0148969 | A1* | 6/2010 | Lian et al. | 340/572.9 |

* cited by examiner

DYNAMIC MAGNETIC DETACHER

STATEMENT REGARDING FEDERALLY SPONSORED RESEARCH OR DEVELOPMENT

N/A

FIELD OF THE INVENTION

The present invention relates to security tag detachers and in particular actuation of a security tag detacher.

BACKGROUND OF THE INVENTION

Electronic article surveillance (EAS) systems are rapidly becoming common place in a vast majority of businesses where removal of items needs to be monitored. Typical EAS systems include an EAS monitoring system and one or more security tags attached to various items that are detected when in range of the EAS monitoring system. For example, the EAS monitoring system creates a surveillance zone at an access point for a controlled or monitored area. When an item having a security tag enters the surveillance zone, the security tag is detected and an alarm is triggered indicating the unauthorized removal of the item from controlled area.

Several types of security tag attachment mechanisms have been implemented to attach the security tag to the item. For example, one type of tag attachment mechanism relies on a magnetic locking mechanism that is housed within the tag. The magnetic locking mechanism engages a tack that has been inserted through an item and into the tag such that removal of the tack, and hence the tag, is prevented. In order to disengage the magnetic locking mechanism from the tack, a magnetic detacher is needed. Some magnetic detachers rely on a permanent magnet that is fixed within the detacher housing such the magnetic locking mechanism disengages from the tack by placing the tag proximate the magnetic detacher. In particular, the magnet moves a latch within the tag to disengage the latch from tack, thereby allowing the tack to be removed. However, this type of magnetic detacher is always active such that the location of the detacher must be fixed or under constant surveillance in order to ensure there is not unauthorized use of the magnetic detacher. For example, a thief may be able to improperly use the magnetic detacher to remove a tag from an article when a point of sale terminal where the magnetic detacher is located is not being operated or monitored by an employee.

SUMMARY OF THE INVENTION

The present invention advantageously provides a method and system for actuating a security tag detacher.

According to one embodiment, a detacher is provided. The detacher includes a field source arranged to provide a first magnetic field when power is applied to the field source. The detacher further includes a magnet arranged to provide a second magnetic field. The magnet is movable from a non-detach position to the detach position by the first magnetic field. The second magnetic field sufficient to unlock a security tag when the magnet is at the detach position.

According to another embodiment, a system is provided. The system includes a detacher. The detacher includes a field source. The field source is arranged to provide a first magnetic field when power is applied to the field source. The detacher further includes a magnet arranged to provide a second magnetic field. The magnet is movable from a non-detach position to a detach position when exposed to the first magnetic field. The second magnetic field is arranged to unlock a security tag when the magnet is at the detach location. The system further includes an activation device. The activation device includes a processor configured to trigger power to be supplied to the field source.

According to another embodiment, a field source is arranged to provide a first magnetic field when power is applied to the field source. The detacher further includes a magnet arranged to provide a second magnetic field. The magnet is movable from a non-detach position to a detach position when exposed to the first magnetic field. The second magnetic field is arranged to unlock a security tag when the magnet is at the detach location. The system further includes an activation device. The activation device includes a processor configured to trigger power to be supplied to the field source.

According to another embodiment, a method for a security tag detacher is provided. The security tag detacher has a field source arranged to provide a first magnetic field and a magnet arranged to provide a second magnet field. A first magnetic field is provided when power is applied to the field source. The first magnetic field is arranged to move the magnet from a non-detach position to detach position. The second magnetic field is sufficient to unlock the security tag when the magnet is in the detach position.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
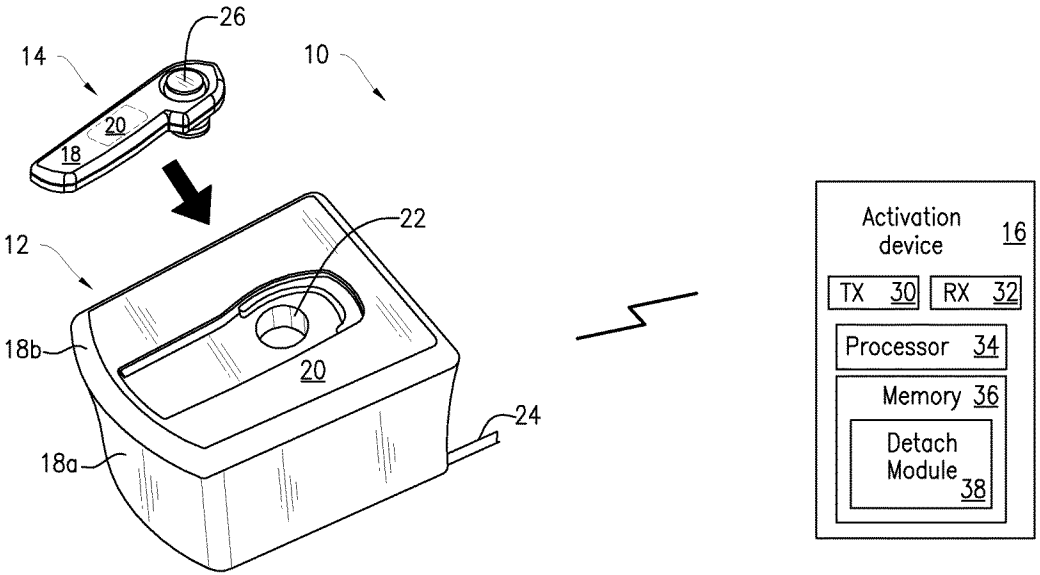
FIG. 1 is a perspective view of a security tag detacher system constructed in accordance with the principles of the present invention.

The present invention advantageously provides a security tag detacher, security tag detachment system and method. Accordingly, the system, device and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Referring now to the drawing figures in which like reference designators refer to like elements there is shown in FIG. 1 a view of an exemplary security tag detacher system constructed in accordance with the principles of the present invention and designated generally as "10." System 10 includes detacher 12, tag 14 and activation device 16. Detacher 12 includes housing 18 having first portion 18*a* and second portion 18*b* (collectively referred to as "housing 18"). Housing 18 contains elements of detacher 12 as described in detail with respect to FIG. 2. Housing 18 includes first side 20 that has a receiving portion 22 in which receiving portion 22 is shaped to receive tag 14. Receiving portion 22 helps position tag 14 in the proper location for detachment. Detacher 12 further includes power connection 24, i.e., power source, which provides power to detacher 12 such an alternating current (AC) power or power from a point of sale (POS) terminal. Alternatively, detacher 12 may include a battery power source.

Tag 14 is an electronic article surveillance tag that is arranged to releasably attach to an article or item as is known in the art. Tag 14 has magnetic locking mechanism 28 that releasably engages tack 26 when inserted into tag 14 and releases from tack 26 when exposed to a magnetic detaching field as is known in the art. The shape of tag 14 is not limited to the shape illustrated and may include other tags 14 shaped and sized to be received by a particular detacher 12. Activation device 14 includes one or more transmitters 30 and one or more receivers 32 for communicating with detacher 12 and/or other devices. Activation device 16 further includes one or more processors 34, in communication with transmitter 30 and receiver 32, for performing the functions described herein.

Activation device 16 further includes memory 36 in communication with processor 34. Memory 36 may include non-volatile and volatile memory. For example, non-volatile memory may include a hard drive, flash memory, memory stick and the like. Also, volatile memory may include random access memory and others known in the art. Memory 36 may store program instructions such as those for detach module 38, among other modules. In particular, detach module 38 includes instructions, which when executed by processor 34, causes processor 34 to perform the detacher activation process, discussed below in detail with respect to FIG. 5. In one embodiment, activation device 16 is coupled to detacher 12 via power connection 24. To activate detacher 12, activation device 16 energizes power connection 24.

Figure 2:
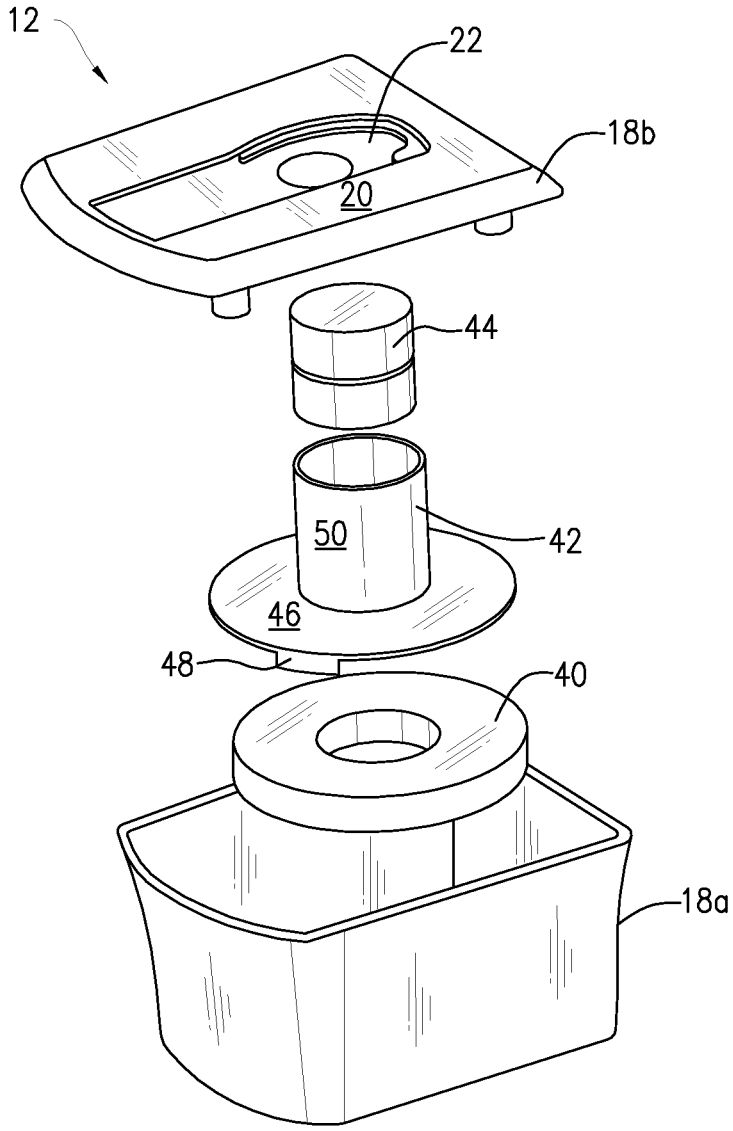
FIG. 2 is an exploded view of the security tag detacher constructed in accordance with the principles of the present invention.

An exploded view of detacher 12 is described with reference to FIG. 2. Detacher 12 includes housing 18, first side 20 and receiving portion 22, as discussed above with respect to FIG. 1. Detacher 12 further includes field source 40, guide 42 and magnet 44. Field source 40 is arranged to provide a first magnetic field 58 (FIG. 4) when power is applied to field source 40. For example, field source 40 may be an air core coil that provides first magnetic field 58 with sufficient field strength to lift or move magnet 44 when power is applied to the air core coil. In other words, field source 40 is a magnetic field source that can be turned on by applying power to field source 40, and turned off by ceasing power application to field source 40. Alternatively, field source 40 may be another magnetic field source such a solenoid that is arranged to physically push magnet by providing first magnetic field 58 when power is applied to field source 40. The position of field source 40 is substantially fixed within housing 18 such as to prevent movement of field source 40 and to help keep guide 42 coaxial with field source 40. In particular, guide 42 includes planar element 46 that is positioned co-axial with field source 40. Planar element 46 includes one or more retaining elements 48 that maintains guide 42 in a coaxial relationship with field source 40 in order to prevent movement of planar element 46 in a direction off of axis 52 (FIG. 3) while disposed on field source 40. At least a portion of planar element 46 may be a magnetic material, i.e., magnetic portion that attracts magnet 44 to planar element 46 such as to help secure magnet 44 in a non-detach position 56 (FIG. 3) when field source 40 is unpowered. Also, field source 40 may have a base magnetic field (not shown) that attracts magnet 44 to help secure magnet 44 in a non-detach position when field source 40 is unpowered, i.e., attracts magnet 44 such that movement of magnet 44 to a detach position 60 due to banging detacher 12 or turning detacher 12 upside down is inhibited when field source 40 is unpowered.

Guide 42 further includes conduit 50 disposed on and perpendicular to planar element 46, i.e., coaxial with field source 40. Conduit 50 is arranged to retain magnet 44 and slidingly direct movement of magnet 44 along axis 52 (FIG. 3) of conduit 50, as discussed in more detail with respect to FIGS. 3-5. Conduit 50 may be positioned substantially over the core of an air coil magnet, i.e., coaxial to air coil magnet. Magnet 44 is a permanent magnet that provides second magnetic field 54 (FIG. 4) that causes magnetic locking mechanism in tag 14 to release such that tag 14 may be removed from an article, i.e., magnet 44 provides a second magnetic field with sufficient field strength to allow tag 14 to be detached from an article. In particular, the range of second magnetic field 54 is arranged such that magnet 44 does not cause locking mechanism of tag 14 to release when magnet 44 is not at the detach position 60.

Figure 3:
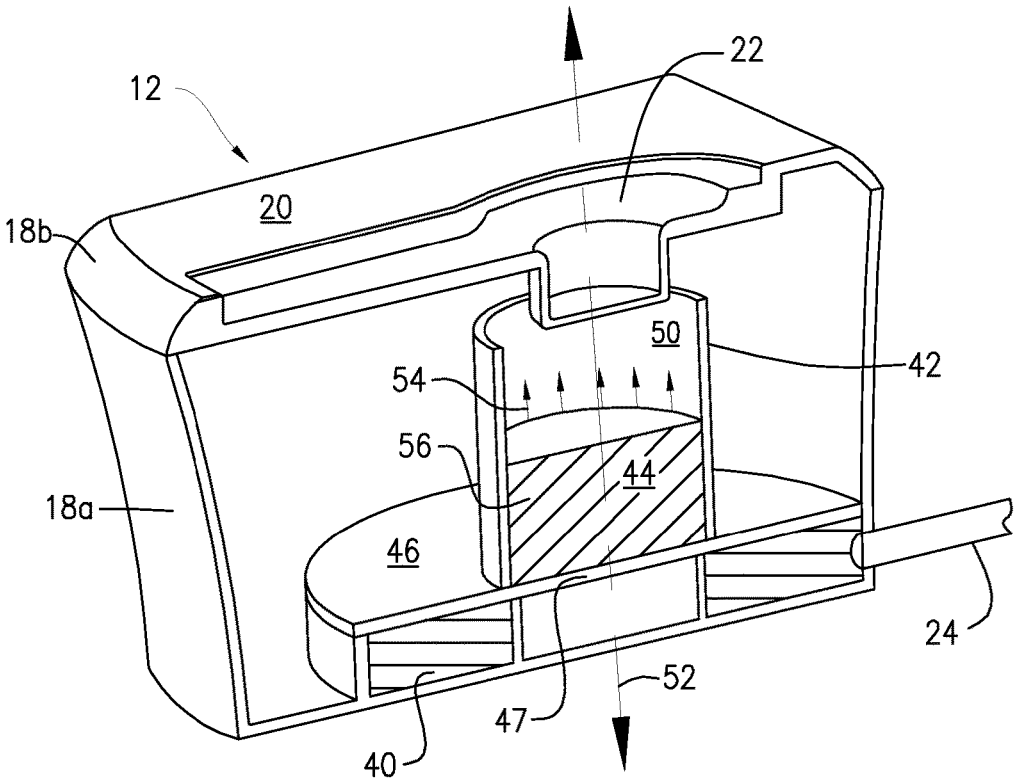
FIG. 3 is a cross-sectional view of the security tag detacher with a magnet in the non-detach position constructed in accordance with the principles of the present invention.

FIG. 3 illustrates a cross-section view of detacher 12 with magnet 44 positioned at non-detach position 56. Magnet 44 and guide 42 are disposed within housing 18 of detacher 12. Planer element 36 of guide 42 is disposed on or positioned over field source 40 such that conduit 50 is positioned coaxial with field source 40. Magnet 44 is positioned at the end of conduit 50 against stop 47 before power is applied to field source 40 via power connection 24, i.e., gravity and/or magnetic attraction of planar element 46 positions magnet 44 in non-detach position 56. Stop 47 of planar element 46 is arranged to prevent magnet 44 from moving into the opening in field source 40. In one embodiment, magnet 44 is a permanent magnet that provides second magnetic field 56 in which second magnet field 56 is insufficient to release locking mechanism of tag 14 if magnet 44 is at non-detach position 56.

Figure 4:
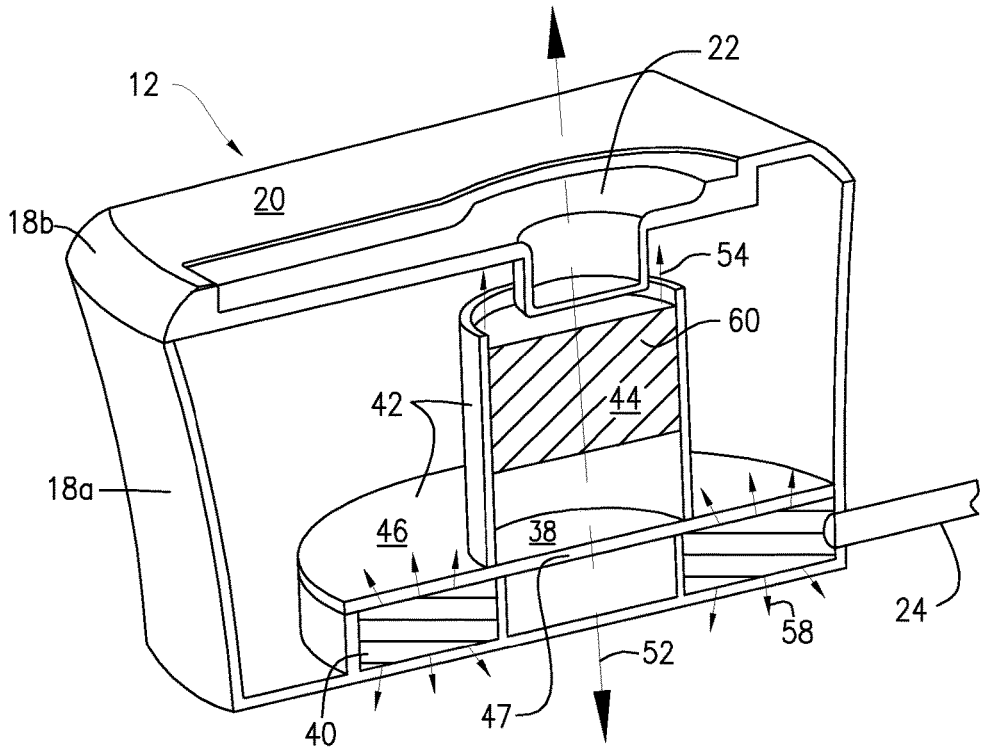
FIG. 4 is a cross-sectional view of the security tag detacher of FIG. 3 where the magnet is in the detach position, constructed in accordance with the principles of the present invention.

A cross-sectional view of detacher 12 with magnet 44 at detach position 60 is described with reference to FIG. 4. Power is applied to field source 40 such that field source 40 generates first magnetic field 58 that moves magnet 44 into detach position 60. Power may be supplied via power connection 24 that provides direct current, DC. Other power supplies known in the art may be used such that field source 40 is provided power sufficient to generate first magnetic field 58. First magnetic field 58 strength is sufficient to overcome gravity and the attraction between magnet 44 and planar element 46 such that magnet 44 is moved within conduit 50 toward first side 20 by first magnetic field 58, i.e., is moved to detach position 60 by first magnetic field 58. Magnet 40 moves back to non-detach position 56 from detach position 60 if field source 40 is unpowered and tag 14 is no longer inserted in receiving portion 22.

Further, magnet 44 is arranged to remain at detach position 60 after power to field source 40 has been stopped if tag 14 remains removably inserted in receiving portion 22, i.e., magnet 44 is kept at detach position 60 due to the attraction between magnet 44 and tag 14. Once tag 14 is removed after power to field source 40 has been stopped, magnet 44 will return to the non-detach position 56 such that a user, i.e., employee, is able to remove the pin from tag 14 without having to apply power to source 40 over the entire tag removal time frame, i.e., from a time when tag 14 is inserted to a time when tag 14 is removed. Limiting the amount of time needed to power field source 40 reduces safety hazards and electrical requirements for each detach cycle.

Figure 5:
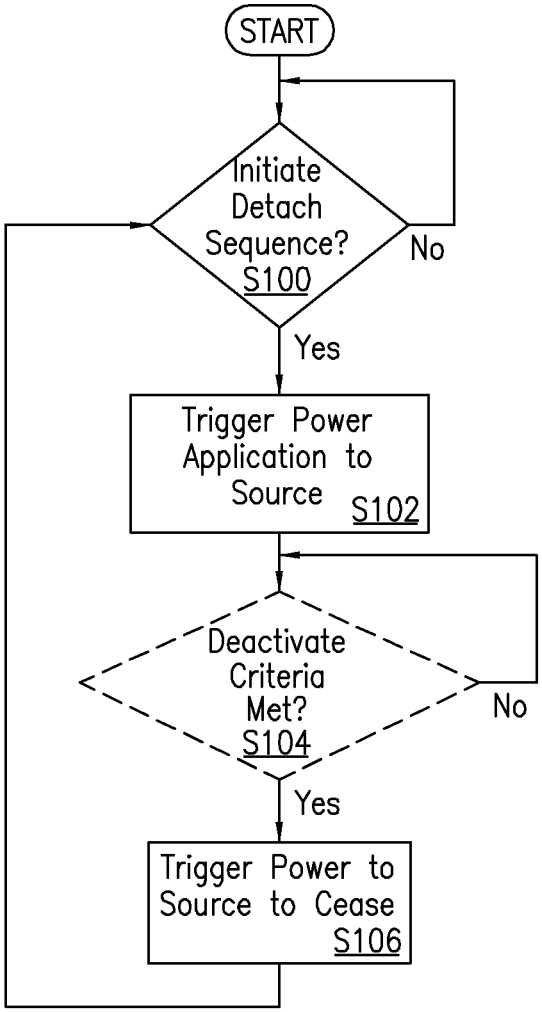
FIG. 5 is an exemplary flow chart of a detach process according to the principles of the present invention.

An exemplary process for initiating the detach sequence is described with respect to FIG. 5. Processor 34 determines whether to initiate the detach sequence (Block S100). For example, processor 34 determines whether to initiate the detach sequence if tag 14 has been removably inserted into receiving portion 22 of detacher 12. In such case, a proximity or other sensor can be used to determine when tag 14 has been placed into receiving portion 22. Alternatively, detacher 12 may be triggered to initiate the detach sequence when triggered by an employee and/or point of sale (POS) terminal. If processor 34 determines not to initiate the detach sequence, the determination of Block S100 is repeated.

If the determination is made to initiate the detach sequence, processor 26 triggers power to be applied to field source 40 such that field source 40 generates first magnetic field 58 (Block S102). Processor 34 determines whether a deactivation criterion is met (Block S104). Deactivation criterion includes one or more rules that, when met, cause processor 34 to trigger power to field source 40 to cease or be stopped. For example, deactivation criterion may include a maximum time that field source 40 can remain powered during a detach cycle, among other rules. In particular, one rule may include a predefined amount of time field source 40 remains powered, e.g., five seconds, ten seconds or another predefined time, such that power to field source 40 is ceased after the predefined amount of time is reached. Another rule may include whether tag 14 is inserted in receive portion 22 of housing 18 such that power to field source 40 is stopped if tag 14 is no longer sensed by detacher 12 as being inserted in receive portion 22.

If the determination is made that the deactivation criterion is not met, processor 34 repeats the determination of Block S104. If processor 26 determines the deactivation criteria is met, processor 26 triggers power to field source 40 to cease such that first magnetic field 58 generation by field source 40 is stopped (Block S106). While activation device 14 is described as performing the determinations in FIG. 5, one or more of these determinations may be performed at detacher 12, POS terminal and/or other device, i.e., detacher 12 and/or POS terminal may includes similar components as activation device 14 as discussed below with respect to FIGS. 6-7.

Figure 6:
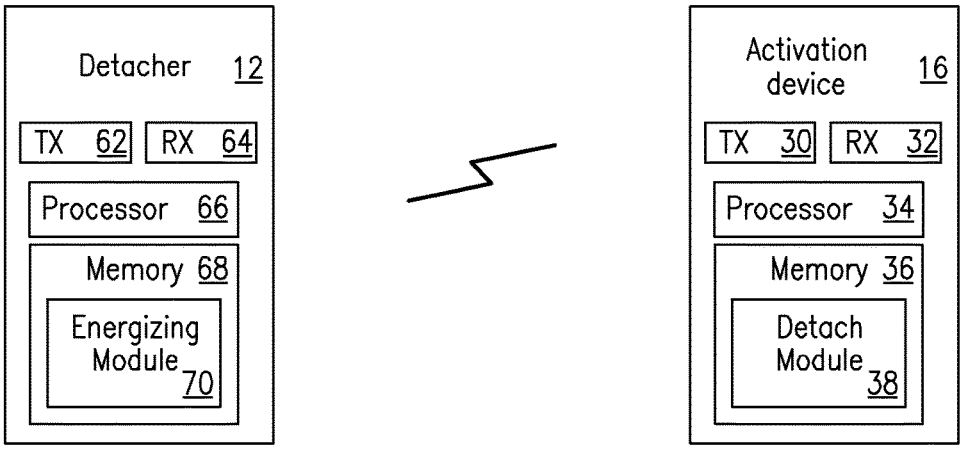
FIG. 6 is a block diagram of an alternative security tag detacher system constructed in accordance with the principles of the present invention.

An alternative embodiment of system 10 is illustrated in FIG. 6. In the embodiment of FIG. 6, detacher 12 includes the same elements as described with reference to FIG. 1 and further includes additional components. For example, detacher 12 may include transmitter 62, receiver 64, processor 66 and memory 68 that generally correspond to components in activation device 14, with size and performance being adjusted based on design needs, while providing the functionality described herein with respect to detacher 12. For example, transmitter 62 and receiver 64 may provide communication to activation device 16 and among other devices. Memory 68 may store energizing module 70, among other modules. Energizing module 70 performs the process of energizing field source 40 or otherwise causing field source 40 to be energized, e.g., through the use of a relay or other switch. For example, energizing module 70 includes instructions, which when executed by processor 66, causes processor 66 to perform the energizing process, discussed in detail below with respect to FIG. 7.

Figure 7:
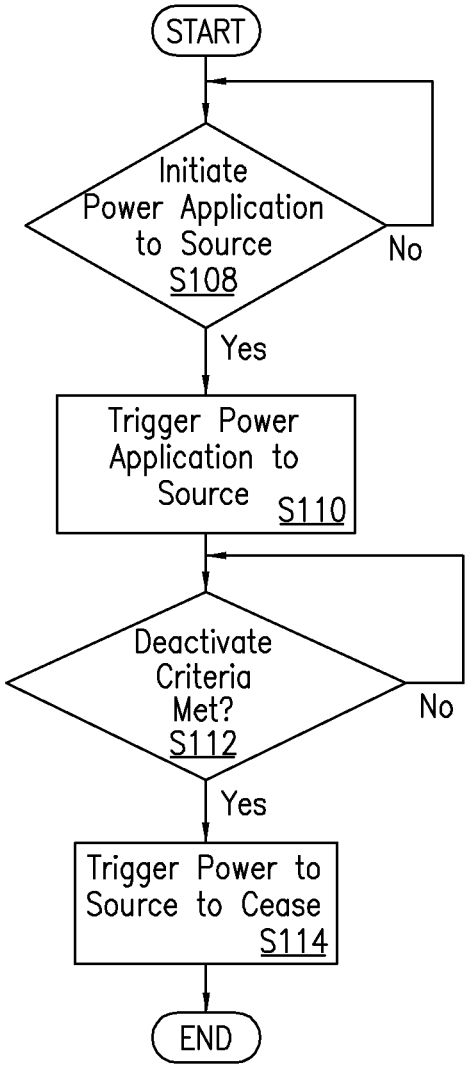
FIG. 7 is a flow chart of an exemplary energizing process according to the principles of the present invention.

FIG. 7 illustrates an exemplary process for detacher 12 to trigger power to field source 40. Processor 66 determines whether to initiate power application to field source 40 (Block S108). For example, detacher 12 may receive a command from activation device or a point of sale (POS) terminal after a transaction in which the command indicates to initiate the application of power to field source 40. In another example, detacher 12 may initiate power to field source 40 if tag 14 is sensed by detacher 12 to have been inserted into receiving portion 22. If the determination is made not to initiate power application to field source 40, the process of Block S108 may be repeated.

If processor 66 determines to initiate power application to field source 40, processor 36 triggers power application to field source 40 such that field source 40 becomes energized and generates first magnetic field 58 (Block S110). Processor 66 determines whether deactivate criteria has been met (Block S112). In particular, the deactivation criteria is substantially the same as discussed above in Block S104. If the determination is made that deactivation criteria is not met, the determination of Block S112 is repeated. If processor 66 determines the deactivation criteria are met, processor 66 triggers power to field source 40 to cease such that magnet 44 may return to non-detach position 56 (Block S114).

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A detacher for unlocking a security tag that can be magnetically released, the detacher comprising:

a stop structure;

a magnet moveable between a non-detach position in which the magnet is adjacent to the stop structure and a detach position in which the magnet is separated a distance from the stop structure;

a field source arranged to provide:

a first magnetic field when power is applied to the field source such that the magnet is repelled in a first direction whereby the magnet is lifted from the non-detach position to the detach position; and a continuous base magnetic field that causes the magnet to move in a second direction opposed from the first direction by way of magnetic attraction such that the magnet transitions from the detach position to the non-detach position when a supply of power to the field source is discontinued; and a security tag receiver positioned proximate to the magnet when the magnet is in the detach position;

wherein the magnet provides a second magnetic field that extends into the security tag receiver when the magnet is at the detach position and not when the magnet is at the non-detach position; and wherein the stop structure resides between the magnet and at least a portion of the field source.

2. The detacher of claim 1, wherein the magnet is movable back to the non-detach location when the power being applied to the field source is stopped, the second magnetic field being insufficient to unlock the security tag when the magnet is at the non-detach position.

3. The detacher of claim 1, further comprising a guide in which the magnet is movably disposed, the guide being arranged to avow relocation of the magnet between the non-detach position and the detach position.

4. The detacher of claim 3, wherein the guide further comprises:

a conduit having a channel, proximate end and distal end, one of the proximate end and distal end being affixed to the planar element, the channel being coaxial with the held source, the magnet being disposed within the channel and arranged to move along the channel;

wherein the conduit abuts the stop structure.

5. The detacher of claim 4, wherein the first magnetic field is arranged to overcome the attraction between the continuous base magnetic field and the magnet.

6. The detacher of claim 4, further comprising a housing having a first side and a second side distal the first side, the first side being shaped to receive the security tag and positioned closer to the detach position than the non-detach position.

7. The detacher of claim 1, wherein the field source is an aft core coil fixed within the detacher and the magnet is a permanent magnet.

8. The detacher of claim 1, wherein the first magnetic field is a direct current, DC, magnetic field.

9. The detacher of claim 1, further comprising a sensor to detect when the security tag has been inserted into the detacher.

10. The detacher of claim 9, wherein the detection by the sensor causes application of the power to the field source.

11. A system for unlocking a security tag that can be magnetically released, the system comprising:

a detacher including:

a magnet moveable between a non-detach position and a detach position; and a field source arranged to provide a first magnetic field when power is applied to the field source such that the magnet is repelled in a first direction whereby the magnet is lifted from the non-detach position to the detach position, and a continuous base magnetic field that causes the magnet to move in a second direction opposed from the first direction by way of magnetic attraction such that the magnet transitions from the detach position to the non-detach position when a supply of power to the field source is discontinued; and an activation device including a processor configured to trigger power to be supplied to the field source;

wherein a stop structure is provided between the magnet and at least a portion of the field source.

12. The system of claim 11, wherein the magnet provides a second magnetic field that is insufficient to unlock the security tag when the magnet is in the non-detach position.

13. The system of claim 11, further comprising a guide coaxial with the field source, having the magnet movably disposed therein, and being arranged to allow relocation of the magnet to and from the detach position.

14. The system of claim 13, wherein the guide further comprises: a planar element; and a conduit, the conduit having a channel, proximate end and distal end, one of the proximate end and distal end being affixed to the planar element, the channel being coaxial with the field source and arranged to guide the magnet.

15. The system of claim 14, wherein the first magnetic field is arranged to overcome the attraction between the continuous base magnetic field and the magnet.

16. The system of claim 11, further comprising a housing having a first side and a second side distal the first side, the first side being shaped to receive the security tag and located closer to the detach position than the non-detach position.

17. The system of claim 11, wherein the processor stops power to the field source when a deactivate criteria is met.

18. A method for manufacturing a security tag detacher for unlocking a security tag that is magnetically releasable, the security tag detacher having a field source arranged to provide a first magnetic field and a magnet arranged to provide a second magnet field, the method comprising:

configuring the field source to provide the first magnetic field when power is applied to the field source such that the magnet is repelled in a first direction whereby the magnet is lifted from a non-detach position to a detach position, and a continuous base magnetic field that causes the magnet to move in a second direction opposed from the first direction by way of magnetic attraction such that the magnet transitions from the detach position to the non-detach position when a supply of power to the field source is discontinued;

configuring a housing having a cavity to hold the magnet in the non-detach position and in the detach position; and configuring a security tag receiver positioned proximate to the magnet when the magnet is in the detach position;

wherein a stop structure is provided between the magnet and at least a portion of the field source.

19. The method of claim 18, wherein the magnet generates a second magnetic field that is insufficient to unlock the security tag when the magnet is in the non-detach position.

20. The method of claim 18, further comprising:

guiding the magnet from the non-detach position to the detach position when the first magnetic field is provided; and guiding the magnet from the detach position to the non-detach position when the first magnetic field is no longer provided.

21. The method of claim 18, further comprising sensing whether a security tag has been received, the power being applied to the field source based at least in part on whether the security tag has been received.

22. The method of claim 18, further comprising attracting the magnet to the non-detach location, the first magnetic field overcoming the attraction.

* * * * *